United States Patent [19]

Greenwald et al.

[11] Patent Number: 4,578,548

[45] Date of Patent: Mar. 25, 1986

[54] SWITCHING DEVICE FOR A COIN CONTROLLED MACHINE

[75] Inventors: Harry Greenwald, Whitestone; Pierre Lier, Wantagh, both of N.Y.

[73] Assignee: Kidde, Inc., Clifton, N.J.

[21] Appl. No.: 666,687

[22] Filed: Oct. 31, 1984

[51] Int. Cl.[4] ..... H01H 7/00

[52] U.S. Cl. ..... 200/38 F; 200/DIG. 3

[58] Field of Search ..... 200/DIG. 3, 52 R, 38 F, 200/153 J; 194/DIG. 1, 92, 9 R, 9 T

[56] References Cited

U.S. PATENT DOCUMENTS 3,075,055 1/1963 Hall ..... 200/38 F 3,735,066 5/1973 Greenwald et al. ..... 200/52 R

*Primary Examiner*—G. P. Tolin

*Assistant Examiner*—Morris Ginsburg

*Attorney, Agent, or Firm*—McAulay, Fields, Fisher, Goldstein & Nissen

[57] ABSTRACT

This disclosure is directed to a switching device for a coin controlled machine in which the device is actuated in response to completion of a predetermined number of cycle of an operator member. The device includes a shaft disposed for rotating a predetermined angular increment each time the operator member cycles. The device includes a first cam and a second cam adjustably positioned on the shaft relative to each other to permit selecting a predetermined distance along the camming surface of the first cam between the initial inoperative position of said first cam and its actuation position. The angle subtended by the selected predetermined distance along the camming surface of the first cam is a multiple of the predetermined increment that the shaft rotates each time the operator member cycles. The arrangement is such that the selected position of the second cam relative to the position of the first cam will determine the number of predetermined increments required to advance the first cam to its actuation position thereby requiring a corresponding number of cycles of the operator member to effect activation of the coin controlled machine.

23 Claims, 18 Drawing Figures

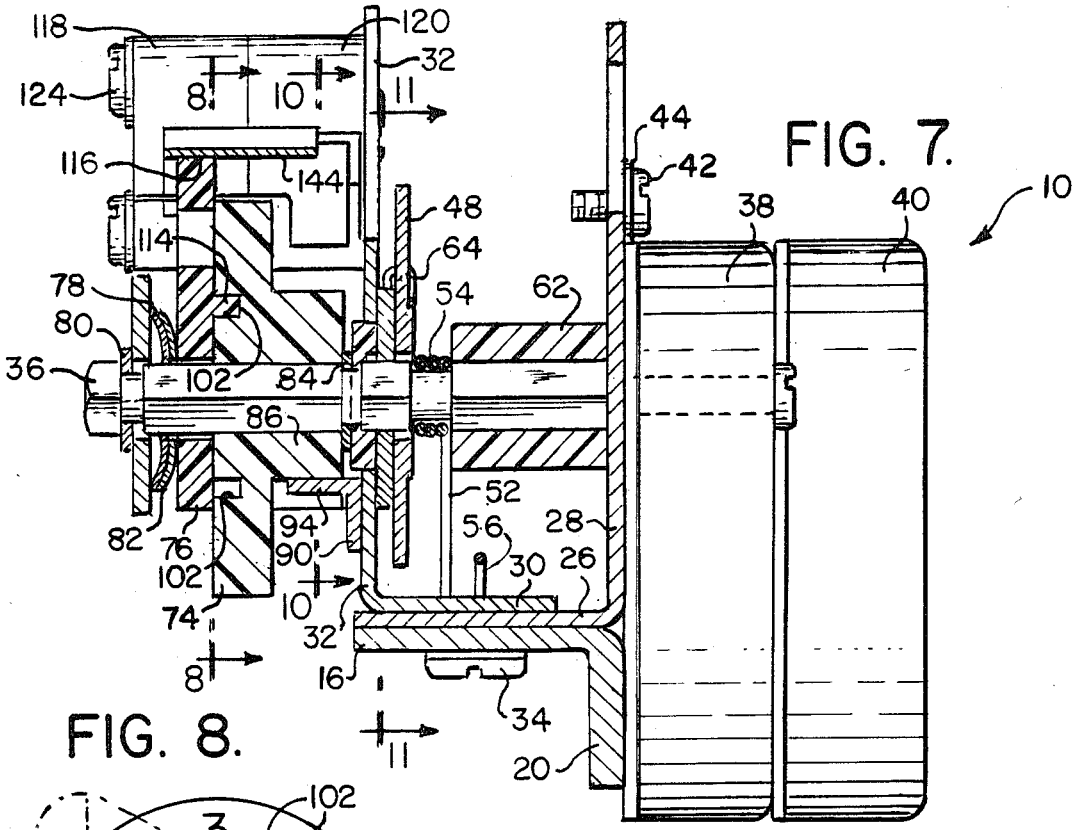
FIG. 7.
FIG. 8.
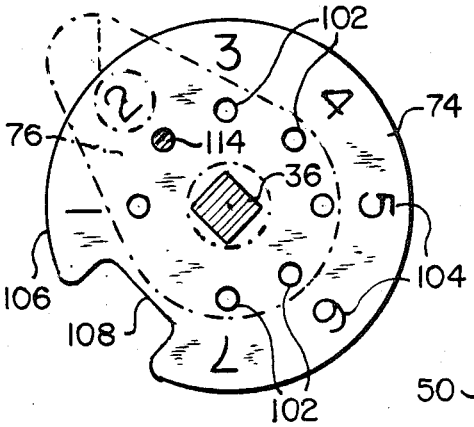
FIG. 10.
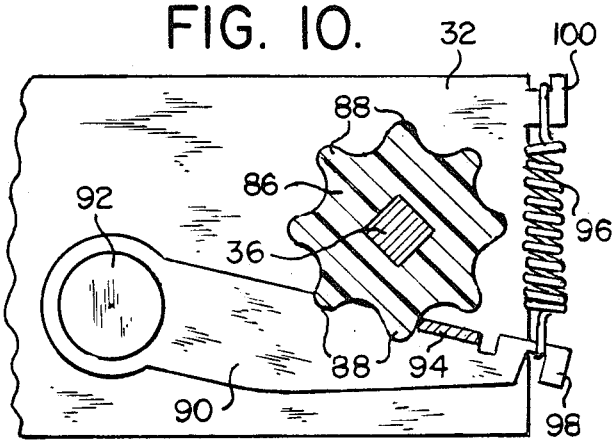
FIG. 11.
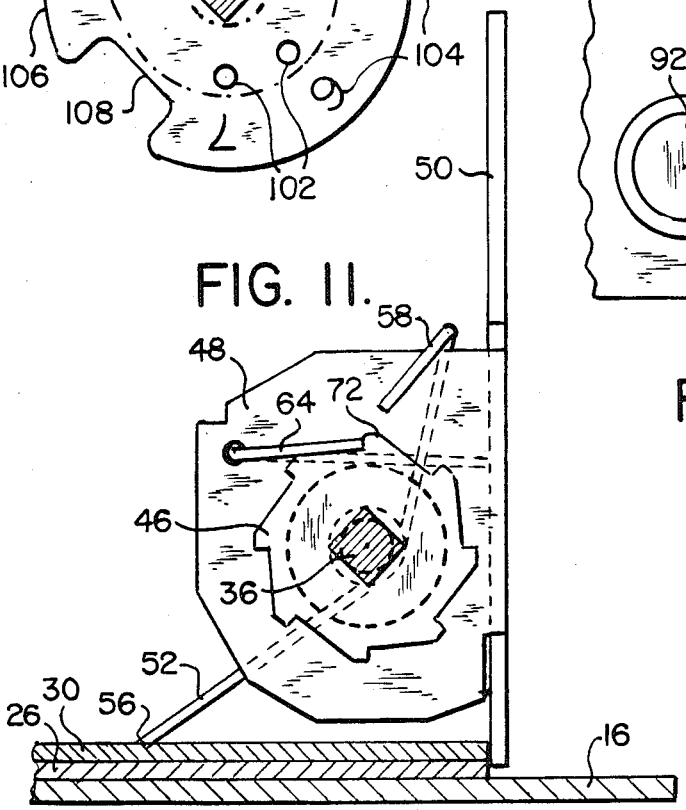
FIG. 9.
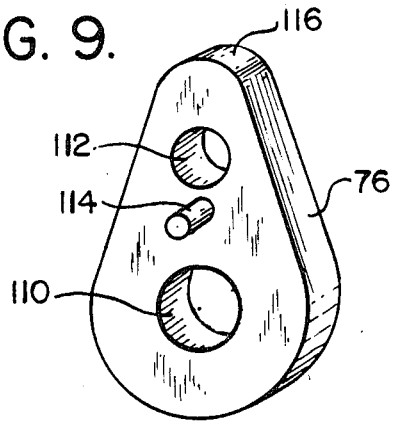

SWITCHING DEVICE FOR A COIN CONTROLLED MACHINE

BACKGROUND OF THE INVENTION

This invention is directed to a switching device for a coin controlled machine in which the device is actuated in response to completion of a predetermined number of cycle of an operator member. In particular, the invention is directed to an improved switching device that enables the owner/operator to adjust the position of a switch actuating mechanism thereof thereby to select the number of cycles of the operator member necessary to effect activation of the coin controlled machine.

Switching devices are used in combination with coin chute assemblies to initiate the operating cycle of commercial appliances, such a clothes washers, dryers, and the like. The assembly typically is enclosed within a housing mounted on the appliance or machine, and includes a coin chute, such as shown by U.S. Pat. No. 3,489,259 and U.S. Pat. No. Re. 31,085, having a coin slide reciprocally mounted in a guide track for inserted and retracted movement. The coin slide is formed having one or more coin receiving slots whereby the presence of an appropriately sized coin in the slot is operative to allow inward or inserted movement of the coin slide to the operate position thereof. The inner end of the coin slide is provided with an operator for actuating a switching device, such as shown in U.S. Pat. Nos. 2,899,622; 2,915,692; 3,735,066; and 4,094,396, upon cyclical movement of the coin slide, closing a circuit to initiate the operating cycle of the machine.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position, whereupon the coins exit from the assembly through suitable openings thereby to be transmitted to the coin receptacle.

In the prior art, switching devices have been proposed to control the operation of a coin operated machine by either a single coin slide insertion withdrawal cycle or a given multiplicity of coin slide insertion/-withdrawal cycles. Multiple cyclical insertions are necessary due to the limited number of coins than may be carried by the coin slide on any given cycle. In this regard, it is not uncommon to have a situation where the price required to operate or vend the machine is set at a value in excess of the value of the coins that can be carried by the coin slide. For example, if the coin slide can only accommodate two quarters, and the vending price is one dollar, the switching device would be set such that it takes two cyclical insertions/withdrawals of the slide to deposit a total of four quarters before the machine is actuated.

An example of such a switching device is disclosed in U.S. Pat. No. 3,735,066, owned by the same assignee of the present application. The switching device of said patent has a pair of series connected switches operated on by the action of two rotary indexed cams whereby each cam actuates a corresponding one of the switches. The cams are indexed by cyclical movements of the coin slide.

More specifically, with reference to U.S. Pat. No. 3,735,066, there is provided a first cam having a plurality of lobes each disposed for actuating engagement with a first switch. The operation is such that the switch is actuated by the cam to a closed state upon the completion of each coin slide cyclical movement. Once the first switch is actuated to its closed state, it is held closed by a latch until released by the action of an electrically operated coil which is energized by conventional means expediently furnished as a part of the machine under control.

A second cam also is provided having a plurality of lobes each disposed for actuating engagement with a second switch. However, unlike the first switch which is actuated to its closed state by the first cam upon the completion of each coin slide cyclical movement, the configuration of the second cam is such that the second switch is maintained in an open state by said cam until the completion of a predetermined number of coin slide cyclical movements, at which time the second switch is actuated by the second cam to its closed state. Electrical conduction through both switches, which is required to effect operation of the machine, is established upon completion of such predetermined number of coin slide movement cycles.

Both of the aforesaid first and second cams are coupled to a common shaft. Reciprocal movement of the coin slide causes an indexing mechanism to rotate the shaft to advance the cams a predetermined angular increment. Thus, depending on the length of the second cam arcuate camming surface, which is a function of the number of lobes, one can select a cam configuration that will effect operation of the machine only after the coin slide completes a predetermined number of cyclical movements.

For example, if the indexing mechanism advances the cams by 60°, and both cams have six equally spaced lobes, then both switches will be actuated to their closed states upon completion of a single cyclical movement of the coin slide. If the first cam has six lobes and the second cam has three lobes, the first switch will be actuated to its closed state upon completion of the first cyclical movement of the coin slide, whereupon it is held closed by the electrically releasable latch. However, the configuration of the second cam now is such that the second switch remains open after the first cyclical movement of the coin slide. It is only at the end of the second coin slide insertion/withdrawal cycle, after the second cam has been advanced 120°, that the second switch will be actuated to its closed state thereby establishing concurrent conduction through both switches. The number of cyclical insertions of the coin slide necessary to operate the machine can be increased to three by selecting a configuration of the second cam having two lobes.

In the situation where the first cam has six lobes, the number of cyclical insertions required for operation of the machine is bounded within the range of 1 to 3. If the number of lobes on the first cam were increased beyond six, the range of cyclical insertions for machine operation also could be increased accordingly to the lobe ratio between the two cams. However, for practical design reasons, the range could not effectively go much higher than four.

In order to replace the second cam with a cam having a different number of lobes, one must disassemble the switching mechanism to gain access to the cams. This requires some degree of skill on the part of the assembler, and also requres that the machine briefly be taken out of service. If the machine assembler does not have the necessary skill, the entire unit may have to be sent back to the manufacturer. The assembler also has to maintain an inventory of cams having different lobes in order to make changes quickly in the field.

The present invention provides a novel and unique switching device which overcomes many of the limitations associated with the heretofore known devices, particularly the switching device of U.S. Pat. No. 3,735,066 previously described. The unique features of the invention enable the assembler to quickly select and modify the switching device to operate the machine based on any number of cyclical coin slide insertions within a given range. This is important since the vending price of many machines today is set at a price beyond the capacity of the coins carried by the coin slide on any given cycle. The present invention has greater flexibility than the heretofore known switching devices in that the assembler now can select the number of cyclical insertions required to operate the machine within a range significantly beyond the range of numbers previously available. The switching device of the present inventions does not have to be disassembled to make the change, nor does the assembler have to be skilled or carry any inventory of cam parts.

SUMMARY

The switching device of the present invention includes a pair of stacked switches acted on by an acutator arm. One of the switches represents an appliance start switch and the other switch represents a homing switch which, when in its operative state, serves to return the appliance start switch to its inoperative state.

The device further includes a rotatably mounted shaft disposed for rotation in response to completion of a predetermined number of cycle of an operator member. In the illustrated embodiment, the shaft rotates a predetermined angular increment each time a coin slide is cyclicly inserted and withdrawn. A first cam is operatively coupled through the shaft for actuating the appliance start switch, and a second cam is operatively coupled through the shaft for actuating the homing switch.

A cam follower serves to connect the cams to the respective switches. The cam follower is disposed to ride on the camming surface of the first cam and be received in a cam notch upon rotation of the shaft to define the actuation position of said first cam. The cam follower also is disposed to rest on the camming surface of the second cam when the homing switch is in its inoperative state, and to ride off the camming surface of the second cam upon rotation of the shaft to define the actuation position of the second cam.

The first and second cams are adjustably positioned on the shaft relative to each other to permit selecting a predetermined distance along the camming surface of the first cam between the initial inoperative position of said first cam and its actuation position. The angle subtended by the selected predetermined distance along the camming surface of the first cam is a multiple of the predetermined increment that the shaft rotates each time the coin slide is cyclicly inserted and withdrawn. The arrangement is such that the selected position of the second cam relative to the position of the first cam determines the number of predetermined increments required to advance the first cam to its actuation position thereby requiring a corresponding number of cyclical insertions and withdrawals of the coin slide to effect activation of the coin controlled machine.

For a better understanding of the invention, and its various features and advantages, reference should be made to the following detailed description when taken in conjunction with the accompanying drawings.

BRIEF DESCRIPTION OF THE DRAWINGS

FIG. 7 is a cross-sectional view taken along line 7—7 of FIG. 2;

FIG. 8 is a cross-sectional view taken along line 8—8 of FIG. 7;

FIG. 9 is a perspective view of a cam employed as an actuating mechanism to actuate a homing switch of the switching device;

FIG. 10 is a cross-sectional view taken along line 10—10 of FIG. 7;

FIG. 11 is a cross-sectional view taken along line 11—11 of FIG. 7;

DESCRIPTION OF THE PREFERRED EMBODIMENT

Figure 1:
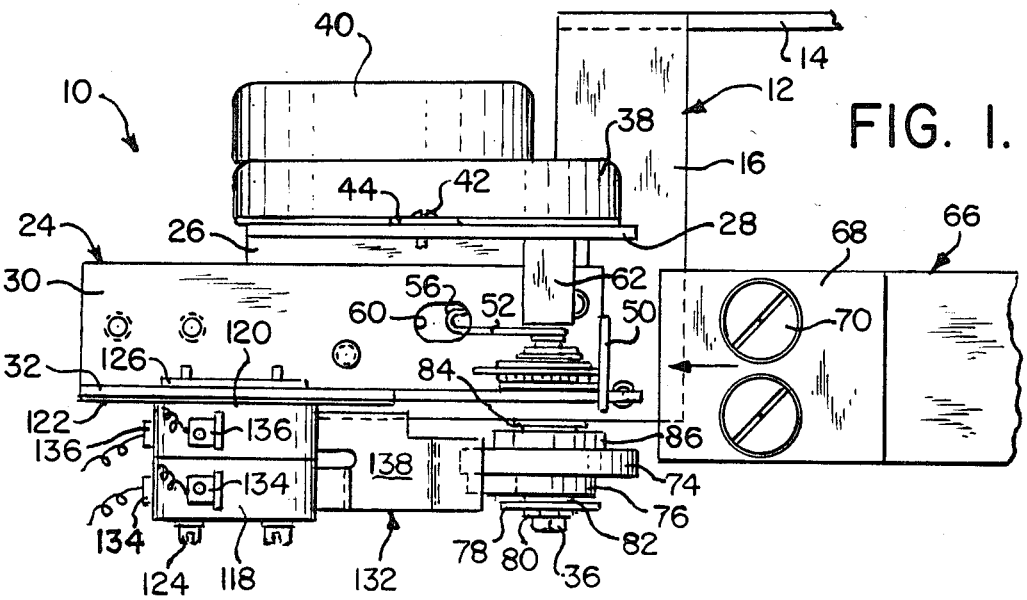
FIG. 1 is a top plan view of a switching device for a coin controlled machine embodying the present invention, ready to be acted on by movement of a coin slide.

Referring to the drawings, there is shown a switching device 10 for a coin controlled machine constructed in accordance with the present invention. It will be assumed that the coin controlled machine is of the type commonly referred to as a commercial appliance, such as a clothes washer. In operation, upon insertion of a preselected number of coins in a suitably mounted coin slide mechanism, and upon reciprocal movement of the coin slide, the switching device 10 will actuate a switch to initiate operation of the appliance through a conventional cycle.

Switching device 10 is illustrated as including a mounting plate, represented by numeral 12, formed having a first section 14 and a second section 16 extending from the first section 14. As shown in the drawings, particularly FIGS. 2 and 3, plate section 14 is vertically oriented and is provided with suitable openings and cut-outs 18 to facilitate mounting the switching device within a housing (not shown). In manufacture, sections 14 and 16 are of one-piece construction with section 16 bent 90° to constitute a horizontally oriented supporting surface for the component parts of the switching device. One edge of plate section 16 is bent downwardly to form a vertically oriented segment 20 disposed in substantial parallel alignment to plate section 14. Segment 20 is regarded as a third section of mounting plate 12.

Secured to plate 12 are a pair of angled brackets represented by numerals 22 and 24 respectively. Bracket 22 is formed having a horizontally oriented base portion 26 and a vertically oriented upright portion 28. Bracket 24 similarly is formed having a horizontally oriented base portion 30 and vertically oriented upright portion 32. The brackets are positioned with their respective base portions 26 and 30 overlying one another, and are mounted to plate section 16 by bolt fasteners 34. The mounting arrangement serves to dispose the upright bracket portions 28 and 32 is spaced parallel relation to one another, as well as in parallel relation to plate section 14.

A shaft 36 is rotably mounted on brackets 22 and 24 having opposite end portions passing through suitable openings in upright bracket portions 28 and 32. One end of shaft 36 is opeatively connected to a gearing mechanism enclosed in a housing 38, which mechanism is operatively connected to a driving mechanism of a homing motor represented by numeral 40. Motor 40 is coupled to housing 38 which, in turn, is mounted to upright bracket portion 28 and plate section 20 by screws 42. In this regard, housing 38 has outwardly projecting wing sections 44 formed with openings through which pass screws 42 for securing said housing in place. Energizing of motor 40 causes rotation of shaft 36 as hereinafter described.

Figure 14:
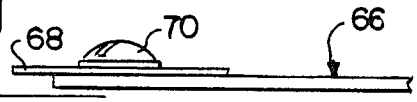
FIG. 14 is a partial front elevational view, similar to FIG. 12, showing the position of the switch actuating cams of the switching device after one cyclical insertion and withdrawal of a coin slide.
Figure 14:
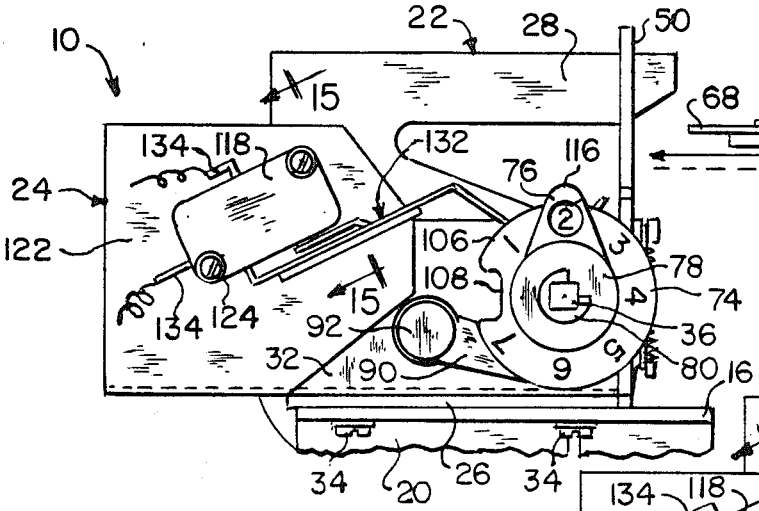
Figure 16:
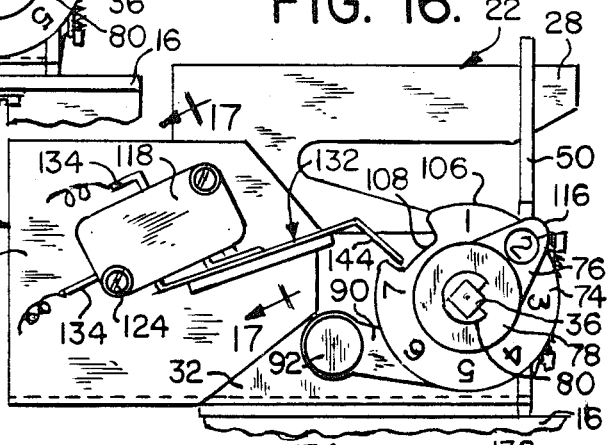
FIG. 16 is a partial front elevational view, similar to FIG. 14, showing the position of the switch actuating cams of the switching device upon completion of two coin slide movement cycles.
Figure 18:
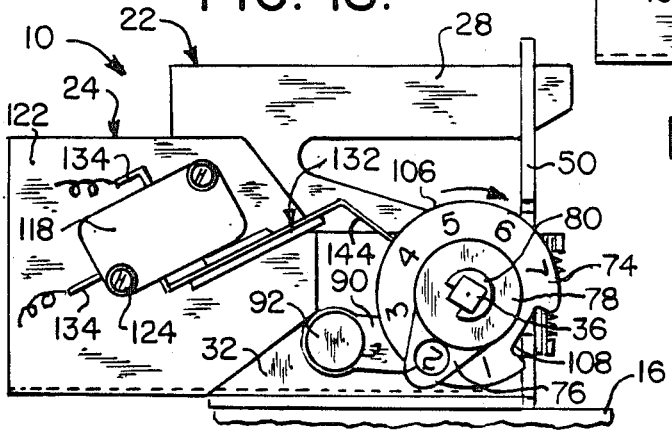
FIG. 18 is a partial front elevational view, similar to FIG. 16, showing rotational movement of the switch actuating cams of the switching device during operation of the coin controlled machine.

Also mounted on shaft 36 for rotation therewith is a ratchet gear 46, shown in FIG. 11, acted on by a ratchet plate 48. The plate 48 is rotatably mounted on shaft 36 and includes an upright portion 50 disposed in the path of movement of a coin slide operator as hereinafter explained. Plate 48 is acted on by a spring 52 having a mid section 54 coiled around shaft 36 and having opposite ends 56 and 58 in contact with bracket portion 30 and ratchet plate 48 respectively. As shown in FIG. 1, the spring end 56 is received within an opening 60 in bracket portion 30 which serves to anchor said spring end portion. The opposite spring end 58 is bent around a top edge of plate 48 as shown in FIG. 11. Spring 52 serves to bias ratchet plate 48 toward the position shown in FIGS. 2, 11 and 14. An elongated spacer element 62 also is rotatably mounted on shaft 36 positioned between the coiled section 54 of spring 52 and the upright portion 28 of bracket 22. A pawl wire 64 is carried by plate 48 for turning gear 46 upon reciprocal movement of the coin slide.

In the embodiment shown in the drawings, the indexing or turning of ratchet gear 46 is caused by reciprocal movement of a coin slide represented generally by numeral 66. However, as noted hereinafter, the use of a coin slide is merely illustrative of one type of operator member that may be employed to effect rotation of gear 46. The forward or inner end of the slide 66 has an operator plate 68 fastened thereto by screws 70. In the operation of coin slide 66, whenever a proper coin or coins are deposited, slide 66 is moved in a forward or inserted direction indicated by the arrow, and then moved in the opposite direction to a retracted or withdrawal position by action of the slide mechanism. Thus, each coin slide movement cycle consists of a prescribed forward coin slide movement and a return coin slide movement. Regardless of whether the machine under control is one requiring a single coin slide insertion or one requiring multiple coin slide insertions, it is important that no activation of the machine occur until after the required number of cyclical insertion/withdrawals have been completed.

Figure 12:
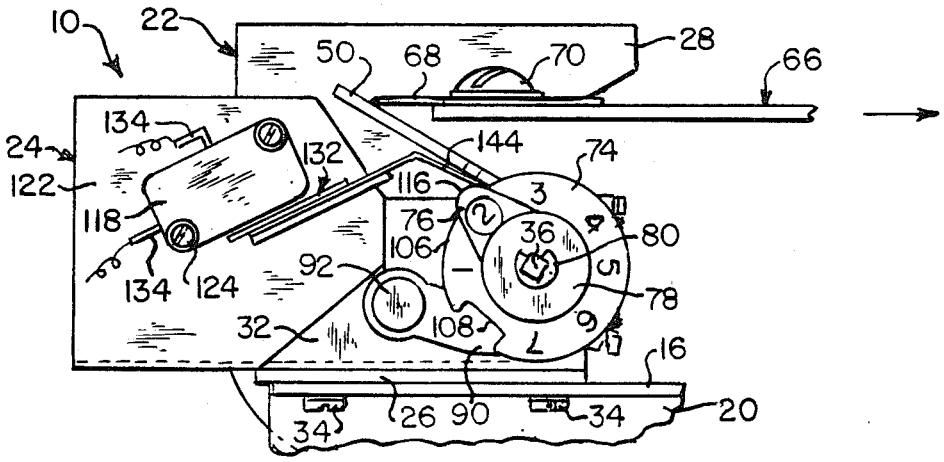
FIG. 12 is a partial front elevational view, similar to FIG. 2, showing the switching device being acted upon by inserted movement of the coin slide.
Figure 13:
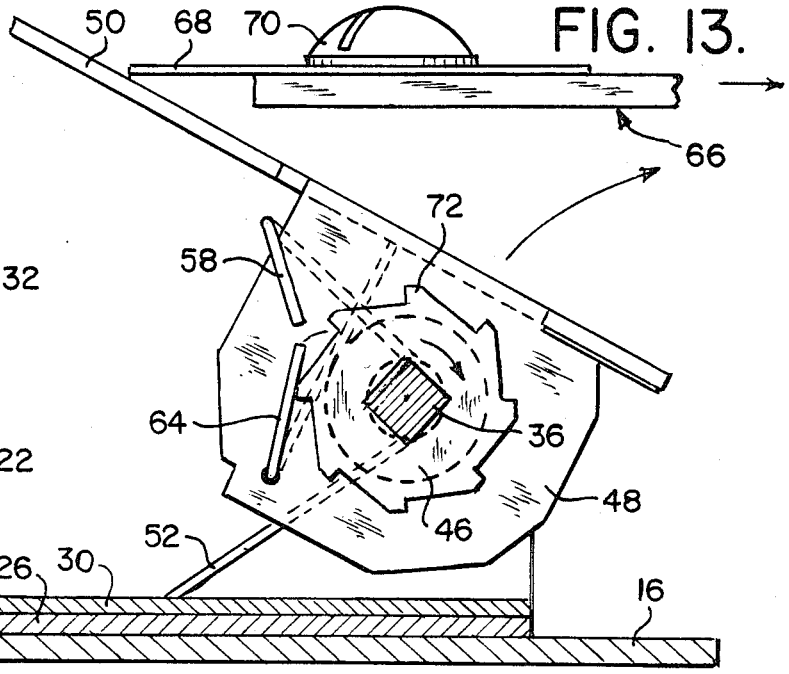
FIG. 13 is a cross-sectional view, similar to FIG. 11, showing the ratchet plate of the switching device being acted upon by inserted movement of the coin slide.

The normal position of ratchet plate 48 is shown in FIG. 11. As such, the end of pawl wire 64 engages ratchet gear 46, and in particular, bears against the trailing face edge portion of a gear tooth 72. When coin slide 66 is moved inwardly, the leading edge of operator plate 68 bears against the upright portion 50 of ratchet plate 48 and turns it counterclockwise relative to shaft 36, as viewed in FIGS. 12 and 13, through a preset angular distance. The pawl wire 64 and ratchet gear 46 are so arranged that during this forward movement of the slide, shaft 36 does not turn. However, the operating end of pawl wire 64 now is positioned to engage the next adjacent gear tooth, as shown in FIG. 13. On the return movement of coin slide 66, the spring loaded ratchet plate 48 rotates clockwise to its initial position under influence of spring 52. This causes the end of pawl wire 64 to engage the face edge portion of said adjacent gear tooth and index the gear 46 a predetermined angular increment. Such movement causes the shaft 36 to similarly be rotated the same angular increment by reason of the keying of gear 46 to shaft 36. Thus, shaft 36 may be described as being rotatably mounted and disposed for rotating a predetermined angular increment each time the coin slide is cyclicly inserted and withdrawn.

Figure 3:
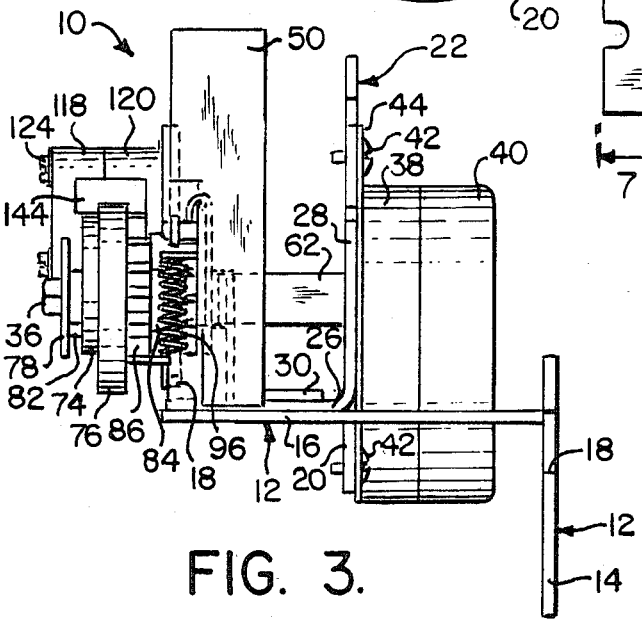
FIG. 3 is a right end elevational view of the switching device of FIG. 1.

The opposite or other end of shaft 36 supports switch actuating mechanisms represented by numerals 74 and 76. Switch actuating mechanism 74 constitutes a first cam keyed to shaft 36 for rotation therewith, and switch actuating mechanism 76 constitutes a second cam rotatably mounted on shaft 36 and adjustably positioned thereon relative to first cam 74. A freely rotatable end disc 78 serves to keep cams 74 and 76 in their proper axial position on shaft 36. In this regard, disc 78 is maintained in its freely rotatable position on shaft 36 by snap ring 80. Positioned between disc 78 and the adjacent cam 76 is a washer-like spring 82 mounted on shaft 36, as shown more clearly in FIG. 7, which urges said cams 74 and 76 into engagement as hereinafter described. Positioned between cam 74 and the upright portion 32 of bracket 24 is a thin spacer 84 rotatably mounted on shaft 36, as shown in FIGS. 1, 3 and 7.

Projecting rearwardly from and axially of cam 74 is a gear-shaped collar extension 86 formed integral with cam 74. Alternatively, extension 86 could be formed as a separate member keyed to shaft 36 for rotation therewith. Extension 86 is formed having a plurality of teeth 88, as shown in FIG. 10, which operatively engage with a lever 90 pivotally mounted on bracket 32 by means of pivot pin 92. More specifically, with reference to FIGS. 7 and 10, lever 90 is formed with a transversely extending arm 94 disposed to engage a particular one of said teeth 88 under influence of a spring 96. The spring has one end connected to the free notched end 98 of lever 90 and the opposite end connected to a notched edge 100 of bracket 32. The arrangement is such that lever is urged counterclockwise, under influence of spring 96, to position lever arm 94 in engagement with a particular tooth of collar extension 86.

In operation, clockwise rotation of cam 74, caused by similar clockwise rotation of shaft 36, will displace lever 90 clockwise thereby permitting lever arm 94 to ride over the advancing tooth 88 whereupon spring 96 serves to return lever arm 94 into engagement with the rearward face of the advanced tooth 88 to prevent counterclockwise rotation of cam 74. As will be appreciated, this same structure which prevents counterclockwise rotation of cam 74 similarly prevents counterclockwise rotation of shaft 36 due to the keying arrangment of cam 74 to shaft 36.

As shown in FIGS. 7 and 8, the side of cam 74 opposite to that of collar extension 86 is formed having a plurality of openings 102 spaced arcuately along said side surface, with the center of openings 102 being equidistant from the center of the cam. In the present embodiment, there are seven such openings 102. Numerical indicia 104 is provided on said side surface of cam 74 identifying each opening with a particular number, such as from one to seven. Furthermore, the circumference or outer perimeter of cam 74 defines a camming surface 106 which is interrupted by a recessed notch 108. This notch 108 represents the actuation position of cam 74 as hereinafter explained. The openings 102 are numbered sequentially with the first numbered opening positioned to the right of notch 108, as viewed in FIG. 8, and with numbers "2" through "7" serving to identify successive openings extending clockwise from opening number "1".

The second switch actuating mechanism, represented by cam 76, is shown in FIG. 9. Cam 76 is formed having a first opening 110 through which passes shaft 36. A second opening 112 is located adjacent the tapered end of cam 76. Positioned between openings 110 and 112 is a post 114 projecting outwardly from the innnr facing surface of cam 76. The arrangement is such that when second cam 76 is rotatably mounted on shaft 36 by means of first opening 110, the second cam is rotated relative to first cam 74 to cause post 114 to be received in one of the openings 102 in cam 74. The second opening 112 of cam 76 is positioned such that numerical indicia 104 is visible therethrough thereby identifying the particular one of the numbered openings "1" through "7" selected for receiving post 114. For example, in FIGS. 2 and 8, the post 114 has been received in the second numbered opening so that the number "2" is exposed to view through cam opening 112. Post 114 and openings 112 thus may be regarded as interengaging means which, in cooperation with disc 78 and spring 82, permit cams 74 and 76 to be adjustably positioned angularly relative to each other. Cam 76 further is formed having a camming surface 116 at its tapered end which defines the inoperative position of said cam as hereinafter explained.

When cams 74 and 76 are coupled to each other amd mounted on shaft 36, the respective camming surfaces 106 and 116 which define the respective inoperative positions of said cams, and the recessed notch 108 which defines the actuation position of cam 74, are each located at different radial distances from the axis of shaft 36. For example, as shown in the drawing, when the cams are in the their coupled position, the camming surface 116 of cam 76 projects above the camming surface 106 of cam 74. Thus, using the axis of shaft 36 as a reference point, camming surface 116 is located at a greater radial distance from the axis of said shaft than is camming surface 106. It also follows that camming surface 106 is located at a greater radial distance from the axis of said shaft than is recessed notched 108.

Figure 2:
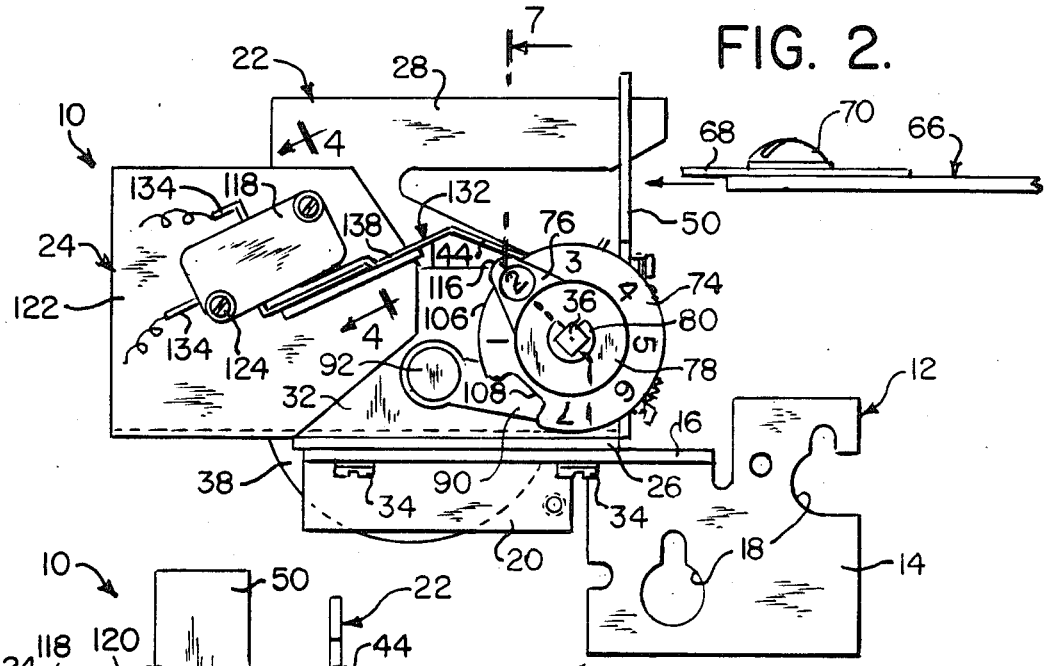
FIG. 2 is a front elevational view of the switching device of FIG. 1.
Figure 4:
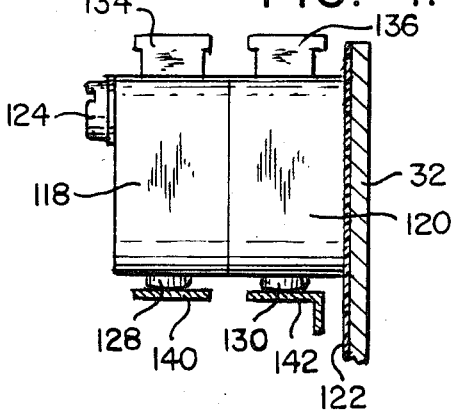
FIG. 4 is a cross-sectional view taken along line 4—4 of FIG. 2.
Figure 15:
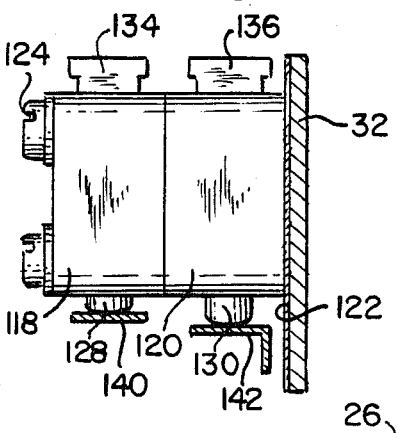
FIG. 15 is a cross-sectional view taken along line 15—15 of FIG. 14.
Figure 17:
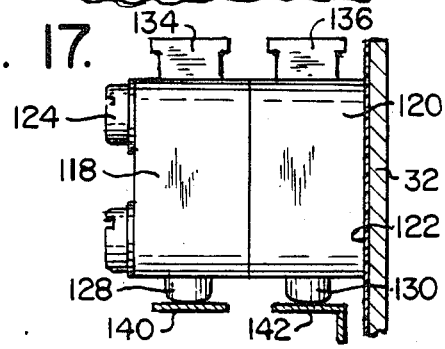
FIG. 17 is a cross-sectional view taken along line 17—17 of FIG. 16.

Mounted on the upright portion 32 of bracket 24 are a pair of stacked switches 118 and 120. The top or upper switch 118, as viewed in FIGS. 1 and 2, is the appliance start switch and the bottom or lower switch 120 is the so-called homing switch. An insulating material 122 having a high resistance is positioned between switch 120 and upright bracket portion 32. Switches 118 and 120 are mounted to upright bracket portion 32 by screws 124, the ends of which pass through lock washer plate 126. Switches 118 and 120 each have protruding contact buttons 128 and 130, respectively, as shown in FIGS. 4, 15, and 17, which are disposed for reciprocal movement between ON-OFF positions. A common switch actuator arm, represented generally by numeral 132, regulates the ON-OFF sequencing of both switches 118, 120 as hereinafter described. Switches 118 and 120 also have outer contact tabs 134 and 136, respectively, which are connected to electrical leads in conventional manner.

Figure 5:
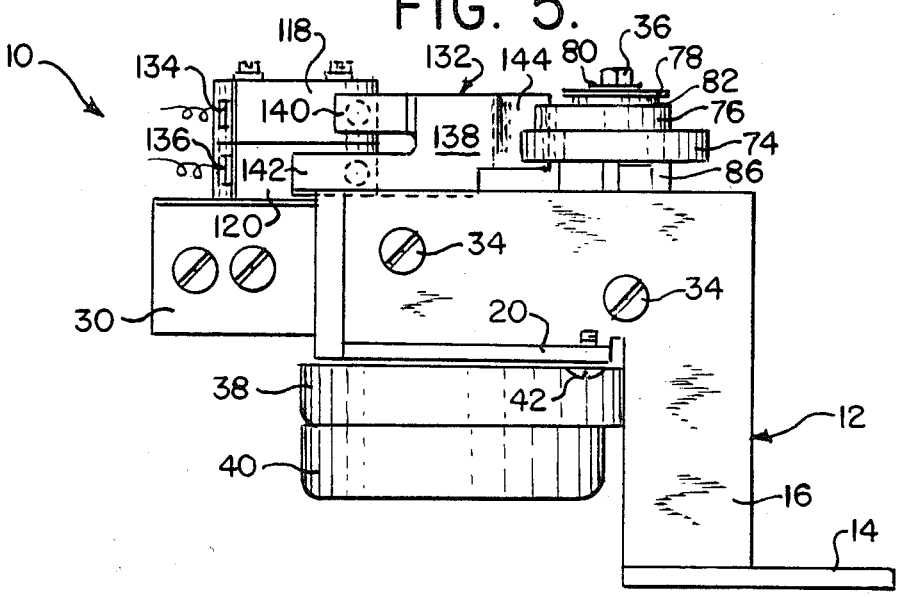
FIG. 5 is a bottom plan view of the switching device of FIG. 1.

Switch actuator arm 132 is in the form of a bifurcated plate 138 having a first finger portion 140 in contact with switch button 128 and a second finger portion 142 in contact with switch button 130. The end of finger portion 142 is bent upwardly and received in an opening in the bottom of switch 120, as shown in FIG. 5, to serve as an anchor or pivot point. The opposite end portion of plate 138 terminates in a downwardly bent cam follower segment 144 which serves to connect cam 74 to switch 118 and connect cam 76 to switch 120 for activating said switches as hereinafter described. In this regard, finger portion 140 is disposed in a plane higher than the plane of finger portion 142 to activate the switches 118, 120 in a desired sequence for reasons that will become hereinafter apparent.

In operation, each of said switches 118, 120 is regarded as having an operative state and an inoperative state. When the appliance is in the OFF position, and the coin slide 66 is in its retracted position ready to receive coins, both the start switch 118 and the homing switch 120 are in their open or inoperative states. The inoperate states of switches 118, 120 correspond to when switch buttons 128 and 130 are displaced inwardly, as shown in FIG. 4, by action of finger plate portions 140, 142. Such action results from cam follower 144 being positioned in contact with camming surface 116 of cam 76, as shown in FIG. 2, which defines the inoperative position of said cam.

In accordance with the teachings of the invention, the operator is able to "dial-in" the number of coin slide cyclical insertions and withdrawals necessary to effect activation of the appliance. This is achieved by selectively positioning cam 76 relative to cam 74 by means of the interengagement of post 114 into one of the openings 102, thereby to vary the distance along the camming surface 106 of cam 74 between the initial inoperative position of said cam and its actuation position as defined by notch 108.

The initial inoperative position of cam 74 is determined by the final inoperative position of cam 76, which in turn, is a function of the position to which cam 76 is dialed on cam 74. For example, with reference to the drawings, cam 76 has been dialed to the second one of the openings 102. This is reflected from the appearance of the number "2" through cam opening 112. In such position, camming surface 116 of cam 76 defines the initial as well as the final inoperative position of cam 76. This also serves to locate the initial inoperative position of cam 74.

As previously indicated, shaft 36 is disposed for rotating a predetermined angular increment each time the coin slide 66 is cyclicly inserted and withdrawn. However, since cam 74 is keyed to shaft 36, cam 74 will also advance a predetermined angular increment upon each angular incremental rotation of said shaft. Such angular incremental rotational movement of cam 74 is translated into a predetermined distance along the camming surface 106. As such, the angle subtended by the distance along the camming surface 106 measured from the initial inoperative position of cam 74 to its actuation position is a multiple of the angular incremental rotation of shaft 36. Accordingly, based on cam 76 being dialed to position number "2", cam 74 will have to rotate two angular increments from its initial inoperative position to reach its actuation position where cam follower 144 is received in notch 108. It thus follows that by selecting the number of increments required to rotate cam 74 a distance measured along its camming surface from its initial inoperative position to its actuation position, one will automatically have determined the number of angular incremental rotational movements of shaft 36 required to advance cam 74 to its actuation position thereby requiring a corresponding number of cyclical insertions and withdrawals of the coin slide 66 to effect activation of the appliance. For example, if cam 76 is dialed on cam 74 to position number "4", it will take four cyclical insertions of coin slide 66 to advance cam 74 to its actuate position where cam follower segment 144 is received in notch 108. Such movement of cam follower 144 causes actuator arm 132 to disengage from switch button 128 thereby to activate switch 118 to its operate state to effect operation of the appliance.

Homing switch 120 is activated to its operative state upon retracted movement of coin slide 66 on the very first cyclical insertion/withdrawal of the slide. This comes about by reason of the clockwise rotation of shaft 36 caused by the indexing of ratchet gear 46 when coin slide 66 is withdrawn. Rotation of shaft 36 cause similar clockwise rotation of nested cams 74, 76. Clockwise rotation of cam 76 causes cam follower 144 to ride off the raised camming surface 116 on to the camming surface 106 of cam 74. Such movement of cam follower 144 causes the finger portion 142 of actuator arm 132 to disengage from switch button 130 thereby to activate switch 120 to its operative state. Accordingly, cam 76 may be regarded as advancing from an inoperative position when cam follower 144 engages camming surface 116 to an actuation position when cam follower 144 rides off said camming surface 116 upon rotation of shaft 36.

Because finger portion 142 of actuator arm 32 is disposed in a lower plane than finger portion 140, homing switch 120 is actuated to its operate state before that of appliance start switch 118. The significance of the sequencing of switches 118, 120 becomes apparent when considered with the description of the circuit of FIG. 6.

Figure 6:
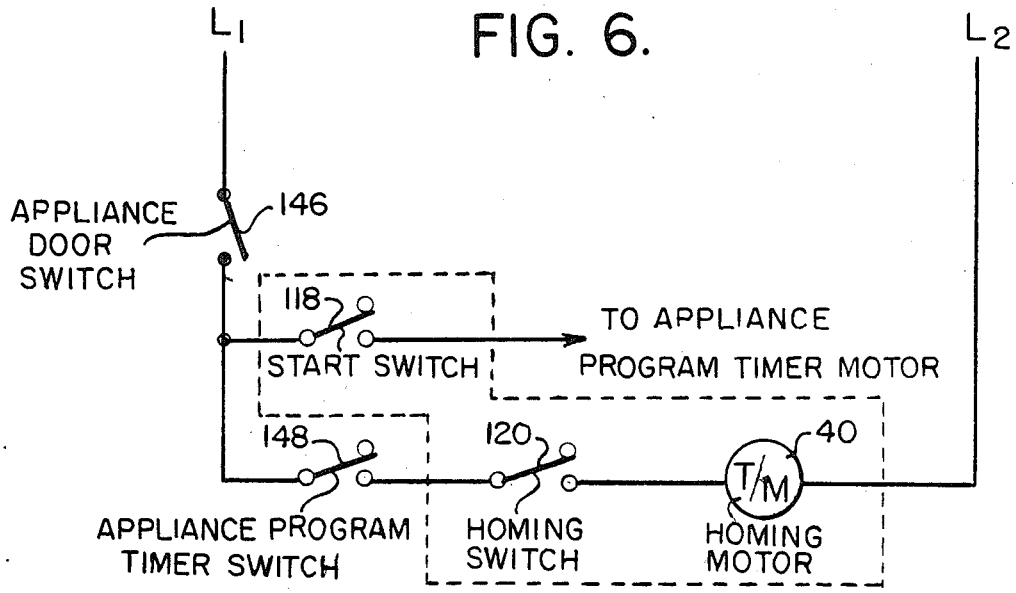
FIG. 6 is a schematic diagram illustrating the electrical circuit of the switching device of the invention.

Referring to FIG. 6, the appliance has a safety door switch 146 which, when in its open or inoperative state, either prevents completion of the circuit to the appliance program timer or interrupts such circuit to stop the appliance.

For the present discussion, we may assume that cam 76 has been dialed-in to position number "2". As previously noted, homing switch 120 is activated to its operative state upon retracted movement of coin slide 66 on the very first cyclical insertion/withdrawal of the slide. This is shown in FIG. 15 wherein homing switch 120 is in its operative state while the appliance start switch 118 is still in its inoperative state. After the last of the selected number of cyclical coin slide insertion/withdrawals is completed, which in this example is "2", cam follower 144 drops into notch 108 of cam 74 thereby activating appliance start switch 118 to its operative state. Switches 118, 120 are both now in their operative states as shown in FIG. 17. Such action completes the circuit to the appliance program timer, thus starting the appliance.

At some time during the machine cycle, the appliance program timer switch 148 closes. It is noted that homing motor 40 is wired in series with homing switch 120 which, in turn, is connected in series with the appliance program timer switch 148. Thus, when appliance program timer switch 148 closes, homing motor 40 is energized through the previously closed homing switch 120. As a result, homing motor 40 will drive cams 74, 76 in a clockwise direction causing cam follower 144 to climb out of notch 108. This serves to open appliance start switch 118 by reason of the action of finger portion 140 of actuator arm 132 engaging button 128 to displace switch 118 to its inoperative state. The position of switches 118, 120 once again now resembles that shown in FIG. 15. The operation is such that when homing switch 120 is in its operative state, it serves to return the appliance start switch 118 to its inoperative state. It will be appreciated that since the appliance start switch 118 opens when the homing phase begins, the energization of the appliance program timer must be taken over by the program timer circuitry itself prior to the homing phase.

Homing motor 40 continues to drive cams 74, 76 clockwise, via continued rotation of shaft 36, until cam follower 144 rides up on camming surface 116 of cam 76. This serves to open homing switch 120 by reason of the action of finger portion 142 of actuator arm 132 engaging button 130 to displace switch 120 to its inoperative state. The position of switches 118, 120, being both open, now, once again, resembles that of FIG. 4. The dialing of cam 76 on cam 74 is such that the final inoperative position of cam 76, which comes after the homing phase, determines the intial inoperate position of cam 74.

For proper operation, the appliance program timer switch 148 must close at some time during the machine cycle after the appliance has started, and must remain closed for a period of time exceeding the time period required to "home" the mechanism. The mechanism homing time is regulated by the rotational speed of homing motor 40 which is preselected depending upon the closure time of the appliance program timer switch 148. The program timer switch must be open at the end of the machine cycle to ready the mechanism and the appliance for the next vend.

Accordingly, there is provided a switching device which, by simply dialing-in the position of cam 76 on cam 74, permits the assembler to select the number of cyclical coin slide insertions/withdrawal required, within a given range, to operate the appliance. Although the range of numbers is disclosed as being between 1 and 7, the range can be increased by using a larger diameter cam 74 thereby to lengthen or increase the circumferential camming surface thereof. The selected number can be dialed-in without any need for extra parts and without having to remove the device from the equipment or appliance.

Although the foregoing description provides for rotation of shaft 36 by means of the cyclical engagement of coin slide 66 with the plate 48 that is operatively coupled to said shaft, it is apparent that other means may be employed for causing such rotation of shaft 36 other than by a cyclicly operated coin slide. For example, in place of coin slide 66, a coin receiving unit may be provided which senses the properly sized coins deposited therein. The sensor would generate an electrical pulse upon acceptance of each coin to energize a solenoid operatively coupled to plate 48 to cause rotation thereof and which, in turn, causes indexing of ratchet gear 46 in the manner heretofore described.

While the present invention has been described with respect to a particular embodiment, it will be readily appreciated and understood that numerous variations and modifications thereof may be made without departing from the spirit or scope of the claimed invention.

We claim:

1. A switching device for a coin controlled machine in which the switching device is actuated in response to completion of a predetermined number of cycles of an operator means, the switching device comprising:

a machine activating switch having an operative state and an inoperative state;

a homing switch having an operative state and an inoperative state, said homing switch when in its operative state serving to return said machine activating switch to its inoperative state;

a shaft rotatably mounted and disposed for rotation a first predetermined angular increment each time the operator means cycles;

a first switch actuating mechanism operatively coupled to said shaft for actuating said machine activating switch, said first mechanism advancing a second predetermined increment upon each angular incremental rotation of said shaft, said first mechanism advancing from an initial inoperative position to an actuation position, the number of second predetermined increments between said initial inoperative position and said actuation position being selectable;

a second switch actuating mechanism operatively coupled to said shaft for actuating said homing switch, said second mechanism advancing from an initial inoperative position to an actuation position upon rotation of said shaft;

the initial inoperative position of one of said first and second switch actuating mechanisms being adjustable relative to the initial inoperative position of the other one of said switch actuating mechanisms;

whereby the selection of the number of second predetermined increments will determine the number of first predetermined increments required to advance said first switch actuating mechanism to its actuation position thereby requiring a corresponding number of cycles of the operator means to effect activation of the coin controlled machine.

2. The switching device of claim 1, in which said first switch actuating mechanism is a first cam and said second switch actuating mechanism is a second cam, said first and second cams having camming surfaces and being adjustably positioned on said shaft relative to each other to permit selecting a predetermined distance along the camming surface of said first cam between the initial inoperative position of said first cam and its actuation position, said distance being determined by the initial inoperative position of said second cam and the actuation position of said first cam, the angle subtended by said predetermined distance being a multiple of said first predetermined increment.

3. The switching device of claim 2, wherein said second predetermined increments are angular increments keyed to rotation of said shaft.

4. The switching device of claim 1, wherein a cycle of the operator means corresponds to a coin slide insertion and withdrawal cycle.

5. A switching device for a coin controlled machine in which the switching device is actuated in response to completion of a predetermined number of cycles of an operator means, the switching device comprising:

a machine activating switch having an operative state and an inoperative state;

a homing switch having an operative state and an inoperative state, said homing switch when in its operative state serving to return said machine activating switch to its inoperative state;

a shaft rotatably mounted and disposed for rotating a predetermined angular increment from an initial position each time the operator means cycles;

a first cam operatively coupled to said shaft for actuating said machine activating switch, said first cam advancing from an initial inoperative position to an actuation position upon rotation of said shaft;

a second cam operatively coupled to said shaft for actuating said homing switch, said second cam advancing from an inoperative position to an actuation position upon rotation of said shaft, said second cam continuing to advance from its actuation position to a final inoperative position upon continued rotation of said shaft, the final inoperative position of said second cam determining the initial inoperative position of said first cam;

said first and second cams having camming surfaces and being adjustably positioned on said shaft relative to each other to permit selecting a predetermined distance along the camming surface of said first cam between the initial inoperative position of said first cam and its actuation position, said distance being determined by the final inoperative position of said second cam and the actuation position of said first cam, the angle subtended by said predetermined distance being a multiple of said predetermined increment;

whereby the selected position of one of said cams relative to the position of the other one of said cams will determine the number of predetermined increments required to advance said first cam to its actuation position thereby requiring a corresponding number of cycles of the operator means to effect activation of the coin controlled machine.

6. The switching device of claim 5, wherein said second cam moves from its final inoperative position to its actuation position upon rotation of said shaft from its initial position to its first incremental position.

7. The switching device of claim 5, further comprising a cam follower connecting said first cam to said machine activating switch, and wherein the camming surface of said first cam is formed having a notch, said cam follower riding on said camming surface and being received in said notch upon rotation of said shaft to define the actuation position of said first cam.

8. The switching device of claim 7, wherein said cam follower further serves to connect said second cam to said homing switch, said cam follower resting on the camming surface of said second cam when said homing switch is in its inoperative state, and riding off the camming surface of said second cam upon rotation of said shaft to define the actuation position of said second cam.

9. The switching device of claim 5, wherein said shaft has an axis about which it rotates, and wherein the inoperative position of said first cam is a first radial distance from the axis of said shaft and the actuation position of said first cam is a second radial distance from the axis of said shaft, said second radial distance being less than said first radial distance.

10. The switching device of claim 9, wherein the final inoperative position of said second cam is a third radial distance from the axis of said shaft, said third radial distance being greater than said first radial distance.

11. The switching device of claim 5, further comprising interengaging means on said first and second cams for keeping said cams in their adjustably selected position relative to each other, said interengaging means comprising a post projecting outwardly from one of said cams, the other one of said cams formed to have a plurality of openings, said post being received in one of said openings upon positioning of said cams relative to each other, and spring means coupled to said shaft for urging said interengaging means into engagement.

12. The switching device of claim 11, wherein said post projects outwardly from a side portion of one of said cams and said openings extend arcuately along a side portion of the other one of said cams, said first and second cams being mounted on said shaft with said side portions disposed in face-to-face relation to permit said cams to be adjustably positioned angularly relative to each other.

13. The switching device of claim 12, wherein said post projects outwardly from said second cam and said openings are formed in said first cam.

14. The switching device of claim 13, wherein said second cam is adjustably positioned relative to said first cam.

15. The switching device of claim 5, further comprising indicia markings on at least one of said cams correlated to the number of said predetermined increments, a selected one of said markings being visible upon positioning of said cams relative to each other to visually indicate the number of cycles of the operator means required to activate the coin controlled machine.

16. The switching device of claim 15, wherein said indicia markings are located on said first cam, and said second cam is formed to have an opening through which a selected one of said markings is visable upon positioning of said cams relative to each other.

17. The switching device of claim 5, wherein a cycle of the operator means corresponds to a coin slide insertion and withdrawal cycle.

18. A switching device for a coin controlled machine in which the switching device is actuated in response to completion of a predetermined number of cycles of an operator means, the switching device comprising:

a machine activating switch having an operative state and an inoperative state;

a homing switch having an operative state and an inoperative state, said homing switch when in its operative state serving to return said machine activating switch to its inoperative state;

a shaft rotatably mounted and disposed for rotating a predetermined angular increment from an initial position each time the operator means cycles;

a first cam operatively coupled to said shaft for actuating said machine activating switch, said first cam advancing from an initial inoperative position to an actuation position upon rotation of said shaft, said first cam having a camming surface formed having a notch;

a second cam operatively coupled to said shaft for actuating said homing switch, said second cam advancing from an inoperative position to an actuation position upon rotation of said shaft from its initial position to its first incremental position, said second cam continuing to advance from its actuation position to a final inoperative position upon continued rotation of said shaft, the final inoperative position of said second cam determining the initial inoperative position of said first cam, said second cam having a camming surface;

a cam follower connecting said first cam to said machine activating switch and connecting said second cam to said homing switch, said cam follower riding on the camming surface of said first cam and being received in said notch upon rotation of said shaft to define the actuation position of said first cam, said cam follower resting on the camming surface of said second cam when said homing switch is in its inoperative state and riding off the camming surface of said second cam upon rotation of said shaft to define the actuation position of said second cam;

and first and second cams being adjustably positioned on said shaft relative to each other to permit selecting a predetermined distance along the camming surface of said first cam between the initial inoperative position of said first cam and its actuation position, said distance being determined by the final inoperative position of said second cam and the actuation position of said first cam, the angle subtended by said predetermined distance being a multiple of said predetermined increment;

whereby the selected position of one of said cams relative to the position of the other one of said cams will determine the number of said predetermined increments required to advance said first cam to its actuation position thereby requiring a corresponding number of cycles of the operator means to effect activation of the coin controlled machine.

19. The switching device of claim 18, wherein said shaft has an axis about which it rotates, and wherein the inoperative position of said first cam is a first radial distance from the axis of said shaft and the actuation position of said first cam is a second radial distance from the axis of said shaft, said second radial distance being less than said first radial distance.

20. The switching device of claim 19, wherein the final inoperative position of said second cam is a third radial distance from the axis of said shaft, said third radial distance being greater than said first radial distance.

21. The switching device of claim 18, further comprising interengaging means on said first and second cams for keeping said cams in their adjustably selected position relative to each other, said interengaging means comprising a post projecting outwardly from one of said cams, the other one of said cams formed to have a plurality of openings, said post being received in one of said openings upon positioning of said cams relative to each other, and spring means coupled to said shaft for urging said interengaging means into engagement.

22. The switching device of claim 18, further comprising indicia markings on at least one of said cams correlated to a multiple of said predetermined increment, a selected one of said markings being visible upon positioning of said cams relative to each other to visually indicate the number of cycles of the operator means required to activate the coin controlled machine.

23. The switching device of claim 18, wherein a cycle of the operator means corresponds to a coin slide insertion and withdrawal cycle.

* * * * *